US007594958B2

(12) United States Patent
Krichtafovitch et al.

(10) Patent No.: US 7,594,958 B2
(45) **Date of Patent: *Sep. 29, 2009**

(54) SPARK MANAGEMENT METHOD AND DEVICE

(75) Inventors: Igor A. Krichtafovitch, Kirkland, WA (US); Vladimir L. Gorobets, Redmond, WA (US)

(73) Assignee: Kronos Advanced Technologies, Inc., Belmont, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/214,066

(22) Filed: Aug. 30, 2005

(65) Prior Publication Data

US 2006/0055343 A1 Mar. 16, 2006

Related U.S. Application Data

(63) Continuation of application No. 10/187,983, filed on Jul. 3, 2002, now Pat. No. 6,937,455.

(51) Int. Cl.
*B03C 3/68* (2006.01)

(52) U.S. Cl. ..... 96/18; 96/20; 96/80; 315/506; 361/235

(58) Field of Classification Search ..... 361/230–235; 123/406.11, 406.12; 315/291, 307, 111.81, 315/111.91, 506, 500, 111.61; 310/308, 310/309; 323/903; 96/80, 18, 20–25
See application file for complete search history.

(56) References Cited

U.S. PATENT DOCUMENTS 1,345,790 A 7/1920 Lodge
1,687,011 A 10/1928 Fleischmann
1,695,075 A 12/1928 Zimmerman
1,758,993 A 5/1930 Wolff
1,888,606 A 11/1932 Nesbit
1,934,923 A 11/1933 Heinrich
1,950,816 A 3/1934 Richardson (Continued)

FOREIGN PATENT DOCUMENTS

DE 1158043 11/1963

(Continued)

OTHER PUBLICATIONS

Humpries, Stanley. "Principles of Charged Particle Acceleration", Department of Eloctrical and Engineering, University of New Mexico, 1999 Download from: <http://www.fiektp.com/cpa/cpa.html>; See, e.g. chapter 9 (attached).

(Continued)

*Primary Examiner*—Douglas W Owens
*Assistant Examiner*—Ephrem Alemu
(74) *Attorney, Agent, or Firm*—Morrison and Foerster LLP

(57) ABSTRACT

A spark management device includes a high voltage power source and a detector configured to monitor a parameter of an electric current provided to a load device. In response to the parameter, a pre-spark condition is identified. A switching circuit is responsive to identification of the pre-spark condition for controlling the electric current provided to the load device so as to manage sparking including, but not limited to, reducing, eliminating, regulating, timing, and/or controlling any intensity of arcs generated.

33 Claims, 6 Drawing Sheets

U.S. PATENT DOCUMENTS

| | | | | | |
|---|---|---|---|---|---|
| 1,959,374 | A | | 5/1934 | Lissman | |
| 2,587,173 | A | | 2/1952 | Landgraf | |
| 2,590,447 | A | | 3/1952 | Nord, Jr. et al. | |
| 2,695,129 | A | | 11/1954 | Stahmer | |
| 2,765,975 | A | | 10/1956 | Lindenblad | |
| 2,768,246 | A | | 10/1956 | Klein | |
| 2,793,324 | A | | 5/1957 | Halus et al. | |
| 2,815,824 | A | | 12/1957 | Armstrong et al. | |
| 2,826,262 | A | | 3/1958 | Byerly | |
| 2,830,233 | A | | 4/1958 | Halus et al. | |
| 2,949,550 | A | | 8/1960 | Brown | |
| 2,950,387 | A | | 8/1960 | Brubaker | |
| 2,961,577 | A | * | 11/1960 | Thomas et al. | 96/21 |
| 2,996,144 | A | | 8/1961 | Phyl | |
| 3,026,964 | A | | 3/1962 | Penney | |
| 3,071,705 | A | | 1/1963 | Coleman et al. | |
| 3,108,394 | A | | 10/1963 | Ellman et al. | |
| 3,144,129 | A | | 8/1964 | Weisberg | |
| 3,198,726 | A | | 8/1965 | Trikilis | |
| 3,223,233 | A | | 12/1965 | Becker et al. | |
| 3,263,848 | A | | 8/1966 | Zackheim | |
| 3,267,860 | A | | 8/1966 | Brown | |
| 3,272,423 | A | | 9/1966 | Bjarno | |
| 3,339,721 | A | | 9/1967 | Goldstein | |
| 3,374,941 | A | | 3/1968 | Okress | |
| 3,436,960 | A | | 4/1969 | Johnson | |
| 3,443,358 | A | * | 5/1969 | Thomas et al. | 95/5 |
| 3,452,225 | A | | 6/1969 | Gourdine | |
| 3,518,462 | A | | 6/1970 | Brown | |
| 3,521,807 | A | | 7/1970 | Weisberg | |
| 3,582,694 | A | | 6/1971 | Gourdine | |
| 3,638,058 | A | | 1/1972 | Fritzius | |
| 3,640,381 | A | | 2/1972 | Kanada et al. | |
| 3,659,777 | A | | 5/1972 | Kanada et al. | |
| 3,660,968 | A | | 5/1972 | Dyla et al. | |
| 3,675,096 | A | | 7/1972 | Kiess | |
| 3,684,156 | A | | 8/1972 | Fettinger et al. | |
| 3,699,387 | A | | 10/1972 | Edwards | |
| 3,740,927 | A | | 6/1973 | Vincent | |
| 3,751,715 | A | | 8/1973 | Edwards | |
| 3,892,927 | A | | 7/1975 | Lindenberg | |
| 3,896,347 | A | | 7/1975 | Gelfand | |
| 3,907,520 | A | | 9/1975 | Huang et al. | |
| 3,918,939 | A | | 11/1975 | Hardt | |
| 3,935,397 | A | | 1/1976 | West | |
| 3,936,635 | A | | 2/1976 | Clark | |
| 3,981,695 | A | | 9/1976 | Fuchs | |
| 3,983,393 | A | | 9/1976 | Thettu et al. | |
| 3,984,215 | A | | 10/1976 | Zucker | |
| 3,990,463 | A | | 11/1976 | Norman | |
| 4,008,057 | A | | 2/1977 | Gelfand et al. | |
| 4,011,719 | A | | 3/1977 | Banks | |
| 4,061,961 | A | * | 12/1977 | Baker | 323/239 |
| 4,086,152 | A | | 4/1978 | Rich et al. | |
| 4,086,650 | A | | 4/1978 | Davis et al. | |
| 4,124,003 | A | | 11/1978 | Abe et al. | |
| 4,126,434 | A | | 11/1978 | Keiichi et al. | |
| 4,136,162 | A | | 1/1979 | Fuchs et al. | |
| 4,136,659 | A | * | 1/1979 | Smith | 123/598 |
| 4,156,885 | A | | 5/1979 | Baker et al. | |
| 4,162,144 | A | | 7/1979 | Cheney | |
| 4,194,888 | A | | 3/1980 | Schwab et al. | |
| 4,210,847 | A | | 7/1980 | Shannon et al. | |
| 4,216,000 | A | | 8/1980 | Kofoid | |
| 4,231,766 | A | | 11/1980 | Spurgin | |
| 4,232,355 | A | | 11/1980 | Finger et al. | |
| 4,240,809 | A | | 12/1980 | Elsbernd et al. | |
| RE30,480 | E | | 1/1981 | Gelfand | |
| 4,246,010 | A | | 1/1981 | Honacker | |
| 4,259,707 | A | | 3/1981 | Penney | |
| 4,266,948 | A | | 5/1981 | Teague et al. | |
| 4,267,502 | A | * | 5/1981 | Reese et al. | 323/237 |
| 4,290,003 | A | * | 9/1981 | Lanese | 323/241 |
| 4,292,493 | A | | 9/1981 | Selander et al. | |
| 4,306,120 | A | | 12/1981 | Klein | |
| 4,313,741 | A | | 2/1982 | Masuda et al. | |
| 4,315,837 | A | | 2/1982 | Rourke et al. | |
| 4,335,414 | A | | 6/1982 | Weber | |
| 4,351,648 | A | | 9/1982 | Penney | |
| 4,369,776 | A | | 1/1983 | Roberts | |
| 4,376,637 | A | | 3/1983 | Yang | |
| 4,379,129 | A | | 4/1983 | Abe | |
| 4,380,720 | A | | 4/1983 | Fleck | |
| 4,388,274 | A | | 6/1983 | Rourke et al. | |
| 4,390,831 | A | * | 6/1983 | Byrd et al. | 323/240 |
| 4,401,385 | A | | 8/1983 | Katayama et al. | |
| 4,428,500 | A | | 1/1984 | Kohler | |
| 4,448,789 | A | | 5/1984 | Yang | |
| 4,460,809 | A | | 7/1984 | Bondar | |
| 4,464,544 | A | | 8/1984 | Klein | |
| 4,477,268 | A | | 10/1984 | Kalt | |
| 4,481,017 | A | | 11/1984 | Furlong | |
| 4,482,788 | A | | 11/1984 | Klein | |
| 4,496,375 | A | | 1/1985 | Le Vantine | |
| 4,516,991 | A | | 5/1985 | Kawashima | |
| 4,567,541 | A | | 1/1986 | Terai | |
| 4,569,852 | A | | 2/1986 | Yang | |
| 4,574,326 | A | | 3/1986 | Myochin et al. | |
| 4,576,826 | A | | 3/1986 | Liu et al. | |
| 4,587,541 | A | | 5/1986 | Dalman et al. | |
| 4,600,411 | A | | 7/1986 | Santamaria | |
| 4,604,112 | A | | 8/1986 | Ciliberti et al. | |
| 4,613,789 | A | * | 9/1986 | Herden et al. | 315/58 |
| 4,632,135 | A | | 12/1986 | Lenting et al. | |
| 4,643,745 | A | | 2/1987 | Sakakibara et al. | |
| 4,646,196 | A | | 2/1987 | Reale | |
| 4,649,703 | A | | 3/1987 | Dettling et al. | |
| 4,673,416 | A | | 6/1987 | Sakakibara et al. | |
| 4,689,056 | A | | 8/1987 | Noguchi et al. | |
| 4,713,243 | A | | 12/1987 | Schiraldi et al. | |
| 4,713,724 | A | | 12/1987 | Voelkel et al. | |
| 4,719,535 | A | | 1/1988 | Zhenjun et al. | |
| 4,740,862 | A | | 4/1988 | Halleck | |
| 4,741,746 | A | | 5/1988 | Chao et al. | |
| 4,772,998 | A | | 9/1988 | Guenther, Jr. et al. | |
| RE32,767 | E | | 10/1988 | Jonelis | |
| 4,775,915 | A | | 10/1988 | Walgrove, III | |
| 4,783,595 | A | | 11/1988 | Seidl | |
| 4,789,801 | A | | 12/1988 | Lee | |
| 4,789,802 | A | | 12/1988 | Lee | |
| 4,790,861 | A | | 12/1988 | Watai et al. | |
| 4,808,200 | A | | 2/1989 | Dallhammer et al. | |
| 4,811,159 | A | | 3/1989 | Foster, Jr. | |
| 4,812,711 | A | | 3/1989 | Torok et al. | |
| 4,815,784 | A | | 3/1989 | Zheng | |
| 4,837,658 | A | | 6/1989 | Reale | |
| 4,838,021 | A | | 6/1989 | Beattie | |
| 4,841,425 | A | | 6/1989 | Maeba et al. | |
| 4,848,986 | A | | 7/1989 | Leluschko et al. | |
| 4,849,246 | A | | 7/1989 | Schmidt | |
| 4,853,719 | A | | 8/1989 | Reale | |
| 4,853,735 | A | | 8/1989 | Kodama et al. | |
| RE33,093 | E | | 10/1989 | Schiraldi et al. | |
| 4,878,149 | A | | 10/1989 | Stiehl et al. | |
| 4,924,937 | A | | 5/1990 | Beal et al. | |
| 4,925,670 | A | | 5/1990 | Schmidt | |
| 4,936,876 | A | * | 6/1990 | Reyes | 95/6 |
| 4,938,786 | A | | 7/1990 | Tonomoto et al. | |
| 4,941,068 | A | | 7/1990 | Hofmann et al. | |
| 4,941,353 | A | | 7/1990 | Fukatsu et al. | |
| 4,980,611 | A | * | 12/1990 | Orenstein | 315/225 |
| 4,996,473 | A | | 2/1991 | Markson et al. | |
| 5,004,595 | A | | 4/1991 | Cherukuri et al. | |
| 5,006,761 | A | | 4/1991 | Torok et al. | |

5,012,159 A 4/1991 Torok et al.
5,021,249 A 6/1991 Bunick et al.
5,024,685 A 6/1991 Torok et al.
5,037,456 A 8/1991 Yu
5,055,118 A 10/1991 Nagoshi et al.
5,059,219 A 10/1991 Plaks et al.
5,072,746 A 12/1991 Kantor
5,076,820 A 12/1991 Gurvitz
5,077,500 A 12/1991 Torok et al.
5,087,943 A 2/1992 Creveling
5,136,461 A 8/1992 Zellweger
5,138,348 A 8/1992 Hosaka et al.
5,138,513 A * 8/1992 Weinstein ..... 361/2
5,155,524 A 10/1992 Oberhardt et al.
5,155,531 A 10/1992 Kurotori et al.
5,163,983 A 11/1992 Lee
5,165,799 A 11/1992 Wood
5,180,404 A 1/1993 Loreth et al.
5,199,257 A 4/1993 Colletta et al.
5,215,558 A 6/1993 Moon et al.
5,245,692 A 9/1993 Kawai et al.
5,257,073 A 10/1993 Gross et al.
5,269,131 A 12/1993 Brophy
5,284,659 A 2/1994 Cherukuri et al.
5,302,190 A 4/1994 Williams
5,330,559 A 7/1994 Cheney et al.
5,354,551 A 10/1994 Schmidt
5,368,839 A 11/1994 Aime et al.
5,369,953 A 12/1994 Brophy
5,423,902 A 6/1995 Strutz et al.
5,469,242 A 11/1995 Yu et al.
5,471,362 A * 11/1995 Gowan ..... 361/257
5,474,599 A 12/1995 Cheney et al.
5,484,472 A 1/1996 Weinberg
5,508,880 A 4/1996 Beyer
5,512,178 A 4/1996 Dempo
5,518,730 A 5/1996 Fuisz
5,535,089 A 7/1996 Ford et al.
5,542,967 A 8/1996 Ponizovsky et al.
5,556,448 A 9/1996 Cheney et al.
5,569,368 A 10/1996 Larsky et al.
5,578,112 A 11/1996 Krause
5,601,636 A 2/1997 Glucksman
5,603,971 A 2/1997 Porzio et al.
5,642,254 A * 6/1997 Benwood et al. ..... 361/235
5,656,063 A 8/1997 Hsu
5,661,299 A 8/1997 Purser
5,665,147 A 9/1997 Taylor et al.
5,667,564 A 9/1997 Weinberg
5,700,478 A 12/1997 Biegajski et al.
5,707,422 A 1/1998 Jacobsson et al.
5,707,428 A 1/1998 Feldman et al.
5,726,161 A 3/1998 Whistler
5,769,155 A 6/1998 Ohadi et al.
5,779,769 A 7/1998 Jiang et al.
5,814,135 A 9/1998 Weinberg
5,827,407 A 10/1998 Wang et al.
5,847,917 A 12/1998 Suzuki et al.
5,854,742 A 12/1998 Faulk
5,892,363 A 4/1999 Roman et al.
5,894,001 A 4/1999 Hitzler et al.
5,897,897 A 4/1999 Porzio et al.
5,899,666 A 5/1999 Chung et al.
D411,001 S 6/1999 Pinchuk
5,920,474 A 7/1999 Johnson et al.
5,938,818 A 8/1999 Miller
5,939,091 A 8/1999 Eoga et al.
5,942,026 A 8/1999 Erlichman et al.
5,948,430 A 9/1999 Zerbe et al.
5,951,957 A 9/1999 Simpson
5,973,905 A 10/1999 Shaw et al.
5,982,102 A 11/1999 Andzej
5,993,521 A 11/1999 Loreth et al.
6,007,682 A 12/1999 Hancock et al.
D420,438 S 2/2000 Pinchuk
6,023,155 A 2/2000 Kalinsky et al.
6,039,816 A 3/2000 Morita et al.
6,042,637 A 3/2000 Weinberg
6,056,808 A 5/2000 Krause et al.
D427,300 S 6/2000 Pinchuk
6,084,350 A 7/2000 Ezaki et al.
6,108,504 A 8/2000 Dickhoff
6,125,636 A 10/2000 Taylor et al.
D433,494 S 11/2000 Pinchuk et al.
D434,483 S 11/2000 Pinchuk
6,145,298 A 11/2000 Burton, Jr.
6,152,146 A 11/2000 Taylor et al.
6,163,098 A 12/2000 Taylor et al.
6,167,196 A 12/2000 Huggins, Jr. et al.
6,174,514 B1 1/2001 Cherukuri et al.
6,176,977 B1 1/2001 Taylor et al.
6,177,096 B1 1/2001 Zerbe et al.
6,182,671 B1 2/2001 Taylor et al.
6,187,351 B1 2/2001 Porzio et al.
D438,513 S 3/2001 Pinchuk
6,195,827 B1 3/2001 Dumitriu et al.
6,200,539 B1 3/2001 Sherman et al.
6,203,600 B1 3/2001 Loreth et al.
D440,290 S 4/2001 Pinchuk
6,210,642 B1 4/2001 Lee et al.
6,215,248 B1 4/2001 Noll
6,221,402 B1 4/2001 Itoh et al.
6,224,653 B1 5/2001 Shvedchikov et al.
6,228,330 B1 5/2001 Herrmann et al.
6,231,957 B1 5/2001 Zerbe et al.
6,238,690 B1 5/2001 Kiefer et al.
6,245,126 B1 6/2001 Feldman et al.
6,245,132 B1 6/2001 Feldman et al.
6,270,733 B1 8/2001 Rodden
6,312,507 B1 11/2001 Taylor et al.
6,313,064 B1 11/2001 Miyafuji et al.
6,350,417 B1 2/2002 Lau et al.
6,351,541 B1 2/2002 Zinserling
6,365,215 B1 4/2002 Grainger et al.
6,375,714 B1 4/2002 Rump et al.
6,375,963 B1 4/2002 Repka et al.
6,394,086 B1 5/2002 Barnes et al.
6,404,089 B1 6/2002 Tomion
6,419,903 B1 7/2002 Xu et al.
6,444,240 B1 9/2002 Barkalow et al.
6,469,296 B1 10/2002 Hansen et al.
6,497,899 B2 12/2002 Thombre et al.
6,504,308 B1 * 1/2003 Krichtafovitch et al. ..... 315/111.91
6,517,865 B2 2/2003 Cade et al.
6,534,042 B2 3/2003 Delli Santi et al.
6,574,123 B2 6/2003 Wiser, III et al.
6,603,268 B2 8/2003 Lee
6,603,795 B2 8/2003 Ma et al.
6,664,741 B1 * 12/2003 Krichtafovitch ..... 315/111.91
6,709,484 B2 3/2004 Lau et al.
6,713,026 B2 3/2004 Taylor et al.
6,727,657 B2 * 4/2004 Krichtafovitch et al. ..... 315/111.91
6,749,667 B2 6/2004 Reeves et al.
6,888,314 B2 * 5/2005 Krichtafovitch et al. ..... 315/111.91
6,919,698 B2 7/2005 Krichtafovitch
6,937,455 B2 * 8/2005 Krichtafovitch et al. .... 361/230
6,963,479 B2 11/2005 Krichtafovitch
7,053,565 B2 5/2006 Krichtavitch et al.
7,122,070 B1 10/2006 Krichtafovitch
7,150,780 B2 12/2006 Krichtafovitch
7,157,704 B2 1/2007 Krichtafovitch et al.
7,248,003 B2 7/2007 Krichtafovitch
7,262,564 B2 8/2007 Krichtafovitch et al.

| | | | |
|---|---|---|---|
| 7,410,532 | B2 | 8/2008 | Krichtafovitch et al. |
| 2001/0004046 | A1 | 6/2001 | Taylor et al. |
| 2001/0022964 | A1 | 9/2001 | Leung et al. |
| 2001/0032544 | A1 | 10/2001 | Taylor et al. |
| 2001/0048906 | A1 | 12/2001 | Lau et al. |
| 2002/0079212 | A1 | 6/2002 | Taylor et al. |
| 2002/0098131 | A1 | 6/2002 | Taylor et al. |
| 2002/0122751 | A1 | 9/2002 | Sinaiko et al. |
| 2002/0122752 | A1 | 9/2002 | Taylor et al. |
| 2002/0127156 | A1 | 9/2002 | Taylor |
| 2002/0127190 | A1 | 9/2002 | Zerbe et al. |
| 2002/0131990 | A1 | 9/2002 | Barkalow et al. |
| 2002/0141914 | A1 | 10/2002 | Lau et al. |
| 2002/0150544 | A1 | 10/2002 | Zerbe et al. |
| 2002/0155041 | A1 | 10/2002 | McKinney, Jr. et al. |
| 2003/0008008 | A1 | 1/2003 | Leung et al. |
| 2003/0033176 | A1 | 2/2003 | Hancock |
| 2003/0035841 | A1 | 2/2003 | Dzija et al. |
| 2003/0053962 | A1 | 3/2003 | Zerbe et al. |
| 2003/0147785 | A1 | 8/2003 | Joannou |
| 2003/0165410 | A1 | 9/2003 | Taylor |
| 2003/0170150 | A1 | 9/2003 | Lau et al. |
| 2003/0206837 | A1 | 11/2003 | Taylor et al. |
| 2003/0206839 | A1 | 11/2003 | Taylor et al. |
| 2003/0206840 | A1 | 11/2003 | Taylor et al. |
| 2003/0209420 | A1 | 11/2003 | Taylor et al. |
| 2003/0234618 | A1 | 12/2003 | Krichtafovitch |
| 2004/0004440 | A1 | 1/2004 | Krichtafovitch et al. |
| 2004/0004797 | A1 | 1/2004 | Krichtafovitch et al. |
| 2004/0025497 | A1 | 2/2004 | Truce |
| 2004/0033340 | A1 | 2/2004 | Lau et al. |
| 2004/0047775 | A1 | 3/2004 | Lau et al. |
| 2004/0052700 | A1 | 3/2004 | Kotlyar et al. |
| 2004/0057882 | A1 | 3/2004 | Lau et al. |
| 2004/0079233 | A1 | 4/2004 | Lau et al. |
| 2004/0110458 | A1 | 6/2004 | Kato et al. |
| 2004/0211675 | A1 | 10/2004 | Dong et al. |
| 2004/0212329 | A1 | 10/2004 | Krichtafovitch et al. |
| 2004/0217720 | A1 | 11/2004 | Krichtafovitch et al. |
| 2005/0150384 | A1 | 7/2005 | Krichtafovitch et al. |
| 2005/0151490 | A1 | 7/2005 | Krichtafovitch |
| 2005/0200289 | A1 | 9/2005 | Krichtafovitch et al. |
| 2005/0211415 | A1 | 9/2005 | Arts et al. |
| 2006/0108286 | A1 | 5/2006 | Hambitzer et al. |
| 2006/0112955 | A1 | 6/2006 | Reaves |
| 2006/0177356 | A1 | 8/2006 | Miller |
| 2006/0182672 | A1 | 8/2006 | Hallam |
| 2006/0226787 | A1 | 10/2006 | Kristafovitch et al. |
| 2007/0046219 | A1 | 3/2007 | Krichtafovitch et al. |
| 2007/0247077 | A1 | 10/2007 | Krichtafovitch |
| 2008/0030920 | A1 | 2/2008 | Krichtafovitch et al. |

FOREIGN PATENT DOCUMENTS

| | | |
|---|---|---|
| DE | 4032974 | 5/1991 |
| GB | 926128 | 5/1963 |
| JP | 60-114363 | 6/1985 |
| JP | 63-143954 | 6/1988 |
| WO | WO-94/025170 | 11/1994 |
| WO | WO-2006/046179 | 5/2006 |
| WO | WO-2006/107390 | 10/2006 |

OTHER PUBLICATIONS

Chen, Junhong. "Direct-Current Corona Enhanced Chemical Reactions" Thesis, University of Minnesota, USA. Aug 2002 Download from: <http://www.menet.umn.edu/jhchen/Junhong_dissertation_final.pdf>.

Request for Ex Parto Reexamination under 37 C.F.R. 1.510: U.S. Appl. No. 90/077,276, filed on Oct. 29, 2004.

Manual on Current Mode PWM Controller. LinFinity Microelectronics (SG1842/SG1843 Series, Apr. 2000) Product Catalog of GE-Ding Information Inc. (From Website—www.redsensor.com.tw).

Product Catalog of GE-Ding Information Inc. (From website—www.reedsensor.com.tw).

* cited by examiner

SPARK MANAGEMENT METHOD AND DEVICE

RELATED APPLICATIONS

This is a continuation of U.S. patent application Ser. No. 10/187,983, filed Jul 3, 2002, entitled SPARK MANAGEMENT METHOD AND DEVICE [now U.S. Pat. No. 6,937,455] and is related to the patents entitled ELECTROSTATIC FLUID ACCELERATOR, Ser. No. 09/419,720, filed Oct. 14, 1999 [now U.S. Pat. No. 6,504,308]; METHOD OF AND APPARATUS FOR ELECTROSTATIC FLUID ACCELERATION CONTROL OF A FLUID FLOW, Ser. No. 10/175,947 filed Jun. 21, 2002, [now U.S. Pat. No. 6,664,741]; and AN ELECTROSTATIC FLUID ACCELERATOR FOR AND A METHOD OF CONTROLLING FLUID FLOW, Ser. No. 10/188,069 filed Jul. 3, 2002 [now U.S. Pat. No. 6,727,657], all of which are incorporated herein in their entireties by reference.

BACKGROUND OF THE INVENTION

1. Field of the Invention

The invention relates to a method and device for the corona discharge generation and, especially, to spark and arc prevention and management.

2. Description of the Prior Art

A number of patents (see, e.g., U.S. Pat. No. 4,210,847 of Shannon et al. and U.S. Pat. No. 4,231,766 of Spurgin) have recognized the fact that corona discharge may be used for generating ions and charging particles. Such techniques are widely used in electrostatic precipitators. Therein a corona discharge is generated by application of a high voltage power source to pairs of electrodes. The electrodes are configured and arranged to generate a non-uniform electric field proxite one of the electrodes (called a corona discharge electrode) so as to generate a corona and a resultant corona current toward a nearby complementary electrode (called a collector or attractor electrode). The requisite corona discharge electrode geometry typically requires a sharp point or edge directed toward the direction of corona current flow, i.e., facing the collector or attractor electrode.

Thus at least the corona discharge electrode should be small or include sharp points or edges to generate the required electric field gradient in the vicinity of the electrode. The corona discharge takes place in the comparatively narrow voltage range between a lower corona onset voltage and a higher breakdown (or spark) voltage. Below the corona onset voltage, no ions are emitted from the corona discharge electrodes and, therefore, no air acceleration is generated. If, on the other hand, the applied voltage approaches a dielectric breakdown or spark level, sparks and electric arcs may result that interrupt the corona discharge process and create unpleasant electrical arcing sounds. Thus, it is generally advantageous to maintain high voltage between these values and, more especially, near but slightly below the spark level where fluid acceleration is most efficient.

There are a number of patents that address the problem of sparking in electrostatic devices. For instance, U.S. Pat. No. 4,061,961 of Baker describes a circuit for controlling the duty cycle of a two-stage electrostatic precipitator power supply. The circuit includes a switching device connected in series with the primary winding of the power supply transformer and a circuit operable for controlling the switching device. A capacitive network, adapted to monitor the current in the primary winding of the power supply transformer, is provided for operating the control circuit. Under normal operating conditions, i.e., when the current in the primary winding of the power supply transformer is within nominal limits, the capacitive network operates the control circuit to allow current to flow through the power supply transformer primary winding. However, upon sensing an increased primary current level associated with a high voltage transient generated by arcing between components of the precipitator and reflected from the secondary winding of the power supply transformer to the primary winding thereof, the capacitive network operates the control circuit. In response, the control circuit causes the switching device to inhibit current flow through the primary winding of the transformer until the arcing condition associated with the high voltage transient is extinguished or otherwise suppressed. Following some time interval after termination of the high voltage transient, the switching device automatically re-establishes power supply to the primary winding thereby resuming normal operation of the electrostatic precipitator power supply.

U.S. Pat. No. 4,156,885 of Baker et al., describes an automatic current overload protection circuit for electrostatic precipitator power supplies operable after a sustained overload is detected.

U.S. Pat. No. 4,335,414 of Weber describes an automatic electronic reset current cut-off for an electrostatic precipitator air cleaner power supply. A protection circuit protects power supplies utilizing a ferroresonant transformer having a primary power winding, a secondary winding providing relatively high voltage and a tertiary winding providing a relatively low voltage. The protection circuit operates to inhibit power supply operation in the event of an overload in an ionizer or collector cell by sensing a voltage derived from the high voltage and comparing the sense voltage with a fixed reference. When the sense voltage falls below a predetermined value, current flow through the transformer primary is inhibited for a predetermined time period. Current flow is automatically reinstated and the circuit will cyclically cause the power supply to shut down until the fault has cleared. The reference voltage is derived from the tertiary winding voltage resulting in increased sensitivity of the circuit to short duration overload conditions.

As recognized by the prior art, any high voltage application assumes a risk of electrical discharge. For some applications a discharge is desirable. For many other high voltage applications a spark is an undesirable event that should be avoided or prevented. This is especially true for the applications where high voltage is maintained at close to a spark level i.e., dielectric breakdown voltage. Electrostatic precipitators, for instance, operate with the highest voltage level possible so that sparks are inevitably generated. Electrostatic precipitators typically maintain a spark-rate of 50-100 sparks per minute. When a spark occurs, the power supply output usually drops to zero volts and only resumes operation after lapse of a predetermined period of time called the "deionization time" during which the air discharges and a pre-spark resistance is reestablished. Each spark event decreases the overall efficiency of the high voltage device and is one of the leading reasons for electrode deterioration and aging. Spark generation also produces an unpleasant sound that is not acceptable in many environments and associated applications, like home-use electrostatic air accelerators, filters and appliances.

Accordingly, a need exists for a system for and method of handling and managing, and reducing or preventing spark generation in high voltage devices such as for corona discharge devices.

SUMMARY OF THE INVENTION

It has been found that spark onset voltage levels do not have a constant value even for the same set of the electrodes. A spark is a sudden event that cannot be predicted with great certainty. Electrical spark generation is often an unpredictable event that may be caused my multiple reasons, many if not most of them being transitory conditions. Spark onset tends to vary with fluid (i.e., dielectric) conditions like humidity, temperature, contamination and others. For the same set of electrodes, a spark voltage may have an onset margin variation as large as 10% or greater.

High voltage applications and apparatus known to the art typically deal with sparks only after spark creation. If all sparks are to be avoided, an operational voltage must be maintained at a comparatively low level. The necessarily reduced voltage level decreases air flow rate and device performance in associated devices such as electrostatic fluid accelerators and precipitators.

As noted, prior techniques and devices only deal with a spark event after spark onset; there has been no known technical solution to prevent sparks from occurring. Providing a dynamic mechanism to avoid sparking (rather than merely extinguish an existing arc) while maintaining voltage levels within a range likely to produce sparks would result in more efficient device operation while avoiding electrical arcing sound accompanying sparking.

The present invention generates high voltage for devices such as, but not limited to, corona discharge systems. The invention provides the capability to detect spark onset some time prior to complete dielectric breakdown and spark discharge. Employing an "inertialess" high voltage power supply, an embodiment of the invention makes it possible to manage electrical discharge associated with sparks. Thus, it becomes practical to employ a high voltage level that is substantially closer to a spark onset level while preventing spark creation.

Embodiments of the invention are also directed to spark management such as where absolute spark suppression is not required or may not even be desirable.

According to one aspect of the invention, a spark management device includes a high voltage power source and a detector configured to monitor a parameter of an electric current provided to a load device. In response to the parameter, a pre-spark condition is identified. A switching circuit is responsive to identification of the pre-spark condition for controlling the electric current provided to the load device.

According to a feature of the invention, the high voltage power source may include a high voltage power supply configured to transform a primary power source to a high voltage electric power feed for supplying the electric current.

According to another feature of the invention, the high voltage power source may include a step-up power transformer and a high voltage power supply including an alternating current (a.c.) pulse generator having an output connected to a primary winding of the step-up power transformer. A rectifier circuit is connected to a secondary winding of the step-up power transformer for providing the electric current at a high voltage level.

According to another feature of the invention, the high voltage power source may include a high voltage power supply having a low inertia output circuit.

According to another feature of the invention, the high voltage power supply may include a control circuit operable to monitor a current of the electric current. In response to detecting a pre-spark condition, a voltage of the electric current is decreased to a level not conducive to spark generation (e.g., below a spark level).

According to another feature of the invention, a load circuit may be connected to the high voltage power source for selectively receiving a substantial portion of the electric current in response to the identification of the pre-spark condition. The load circuit may be, for example, an electrical device for dissipating electrical energy (e.g., a resistor converting electrical energy into heat energy) or an electrical device for storing electrical energy (e.g., a capacitor or an inductor). The load device may further include some operational device, such as a different stage of a corona discharge device including a plurality of electrodes configured to receive the electric current for creating a corona discharge. The corona discharge device may be in the form of an electrostatic air acceleration device, electrostatic air cleaner and/or an electrostatic precipitator.

According to another feature of the invention, the switching circuit may include circuitry for selectively powering an auxiliary device in addition to the primary load device supplied by the power supply. Thus, in the event an incipient spark is detected, at least a portion of the power regularly supplied to the primary device may be instead diverted to the auxiliary device in response to the identification of the pre-spark condition, thereby lowering the voltage at the primary device and avoiding sparking. One or both of the primary load and devices may be electrostatic air handling devices configured to accelerate a fluid under influence of an electrostatic force created by a corona discharge structure.

According to another feature of the invention, the detector may be sensitive to a phenomenon including a change in current level or waveform, change in voltage level or waveform, or magnetic, electrical, or optical events associated with a pre-spark condition.

According to another aspect of the invention, a method of spark management may include supplying a high voltage current to a device and monitoring the high voltage current to detect a pre-spark condition of the device. The high voltage current is controlled in response to the pre-spark condition to control an occurrence of a spark event associated with the pre-spark condition.

According to another feature of the invention, the step of monitoring may include sensing a current spike in the high voltage current.

According to a feature of the invention, the step of supplying a high voltage current may include transforming a source of electrical power from a primary voltage level to a secondary voltage level higher than the primary voltage level. The electrical power at the secondary voltage level may then be rectified to supply the high voltage current to the device. This may include reducing the output voltage or the voltage at the device, e.g., the voltage level on the corona discharge electrodes of a corona discharge air accelerator. The voltage may be reduced to a level this is not conducive to spark generation. Control may also be accomplished by routing at least a portion of the high voltage current to an auxiliary loading device. Routing may be performed by switching a resistor into an output circuit of a high voltage power supply supplying the high voltage current.

According to another feature of the invention, additional steps may include introducing a fluid to a corona discharge electrode, electrifying the corona discharge electrode with the high voltage current, generating a corona discharge into the fluid, and accelerating the fluid under influence of the corona discharge.

According to another aspect of the invention, an electrostatic fluid accelerator may include an array of corona discharge and collector electrodes and a high voltage power source electrically connected to the array for supplying a high voltage current to the corona discharge electrodes. A detector may be configured to monitor a current level of the high voltage current and, in response, identify a pre-spark condition. A switching circuit may respond to identification of the pre-spark condition to control the high voltage current.

According to a feature of the invention, the switching circuit may be configured to inhibit supply of the high voltage current to the corona discharge electrodes by the high voltage power supply in response to the pre-spark condition.

According to another feature of the invention, the switching circuit may include a dump resistor configured to receive at least a portion of the high voltage current in response to the identification of the pre-spark condition.

It has been found that a corona discharge spark is preceded by certain observable electrical events that telegraph the imminent occurrence of a spark event and may be monitored to predict when a dielectric breakdown is about to occur. The indicator of a spark may be an electrical current increase, or change or variation in a magnetic field in the vicinity of the corona discharge (e.g., an increase) or other monitorable conditions within the circuit or in the environment of the electrodes. It has been experimentally determined, in particular, that a spark event is typically preceded by a corona current increase. This increase in current takes place a short time (i.e., 0.1-1.0 milliseconds) before the spark event. The increase in current may be in the form of a short duration current spike appearing some 0.1-1.0 milliseconds (msec) before the associated electrical discharge. This increase is substantially independent of the voltage change. To prevent the spark event, it is necessary to detect the incipient current spike event and sharply decrease the voltage level applied to and/or at the corona discharge electrode below the spark level.

Two conditions should be satisfied to enable such spark management. First, the high voltage power supply should be capable of rapidly decreasing the output voltage before the spark event occurs, i.e., within the time period from event detection until spark event start. Second, the corona discharge device should be able to discharge and stored electrical energy, i.e., discharge prior to a spark.

The time between the corona current increase and the spark is on the order of 0.1-1.0 msec. Therefore, the electrical energy that is stored in the corona discharge device (including the power supply and corona discharge electrode array being powered) should be able to dissipate the stored energy in a shorter time period of, i.e., in a sub-millisecond range. Moreover, the high voltage power supply should have a "low inertia" property (i.e., be capable of rapidly changing a voltage level at its output) and circuitry to interrupt voltage generation, preferably in the sub-millisecond or microsecond range. Such a rapid voltage decrease is practical using a high frequency switching high voltage power supply operating in the range of 100 kHz to 1 MHz that has low stored energy and circuitry to decrease or shut down output voltage rapidly. In order to provide such capability, the power supply should operate at a high switching frequency with a "shut down" period (i.e., time required to discontinue a high power output) smaller than the time between corona current spike detection and any resultant spark event. Since state-of-the-art power supplies may work at the switching frequencies up to 1 MHz, specially an appropriately designed (e.g., inertialess) power supply may be capable of interrupting power generation with the requisite sub-millisecond range. That is, it is possible to shut down the power supply and significantly decrease output voltage to a safe level, i.e., to a level well below the onset of an electrical discharge in the form of a spark.

There are different techniques to detect the electrical event preceding an electrical spark. An electrical current sensor may be used to measure peak, or average, or RMS or any other output current magnitude or value as well as the current rate of change, i.e., dI/dt. Alternatively, a voltage sensor may be used to detect a voltage level of the voltage supply or a voltage level of an AC component. Another parameter that may be monitored to identify an imminent spark event is an output voltage drop or, a first derivative with respect to time of the voltage, (i.e., dV/dt) of an AC component of the output voltage. It is further possible to detect an electrical or magnetic field strength or other changes in the corona discharge that precede an electrical discharge in the form of a spark. A common feature of these techniques is that the corona current spike increase is not accompanied by output voltage increase or by any substantial power surge.

Different techniques may be employed to rapidly decrease the output voltage generated by the power supply. A preferred method is to shut down power transistors, or SCRs, or any other switching components of the power supply that create the pulsed high frequency a.c. power provided to the primary of a step-up transformer to interrupt the power generation process. In this case the switching components are rendered non-operational and no power is generated or supplied to the load. A disadvantage of this approach is that residual energy accumulated in the power supply components, particularly in output filtering stages such as capacitors and inductors (including stray capacitances and leakage inductances) must be released to somewhere, i.e., discharged to an appropriate energy sink, typically "ground." Absent some rapid discharge mechanism, it is likely that the residual energy stored by the power supply would be released into the load, thus slowing-down the rate at which the output voltage decreases (i.e., "falls"). Alternatively, a preferred configuration and method electrically "shorts" the primary winding (i.e., interconnects the terminals of the winding) of the magnetic component(s) (transformer and/or multi-winding inductor) to dissipate any stored energy by collapsing the magnetic field and thereby ensure that no energy is transmitted to the load. Another, more radical approach, shorts the output of the power supply to a comparatively low value resistance. This resistance should be, however, much higher than the spark resistance and at the same time should be less than an operational resistance of the corona discharge device being powered as it would appear at the moment immediately preceding a spark event. For example, if a high voltage corona device (e.g., an electrostatic fluid accelerator) consumes 1 mA of current immediately prior to spark detection and an output current from the power supply is limited to 1 A by a current limiting device (e.g., series current limiting resistor) during a spark event (or other short-circuit condition), a "dumping" resistance applied across the load (i.e., between the corona discharge and attractor electrodes of a corona discharge device) should develop more than 1 mA (i.e., provide a lower resistance and thereby conduct more current than a normal operating load current) but less than 1 A (i.e., less than the current limited maximum shorted current). This additional dumping resistor may be connected to the power supply output by a high voltage reed-type relay or other high voltage high speed relay or switching component (e.g., SCR, transistor, etc.). The common and paramount feature of the inertialess high voltage power supply is that it can interrupt power generation in less time than the time from the electrical event preceding and indicative of an incipient spark event and the moment in time when the spark actually would have occurred absent some intervention, i.e., typically in a sub-millisecond or microsecond range.

Another important feature of such an inertialess power supply is that any residual energy that is accumulated and stored in the power supply components should not substantially slow down or otherwise impede discharge processes in the load, e.g., corona discharge device. If, for example, the corona discharge device discharges its own electrical energy in 50 microseconds and the minimum expected time to a spark event is 100 microseconds, then the power supply should not add more than 50 microseconds to the discharge time, so the actual discharge time would not exceed 100 microseconds. Therefore, the high voltage power supply should not use any energy storing components like capacitors or inductors that may discharge their energy into the corona discharge device after active components, such as power transistors, are switched off. To provide this capability and functionality, any high voltage transformer should have a relatively small leakage inductance and either small or no output filter capacitive. It has been found that conventional high voltage power supply topologies including voltage multipliers and fly-back inductors are not generally suitable for such spark management or prevention.

DESCRIPTION OF THE PREFERRED EMBODIMENT

Figure 1:
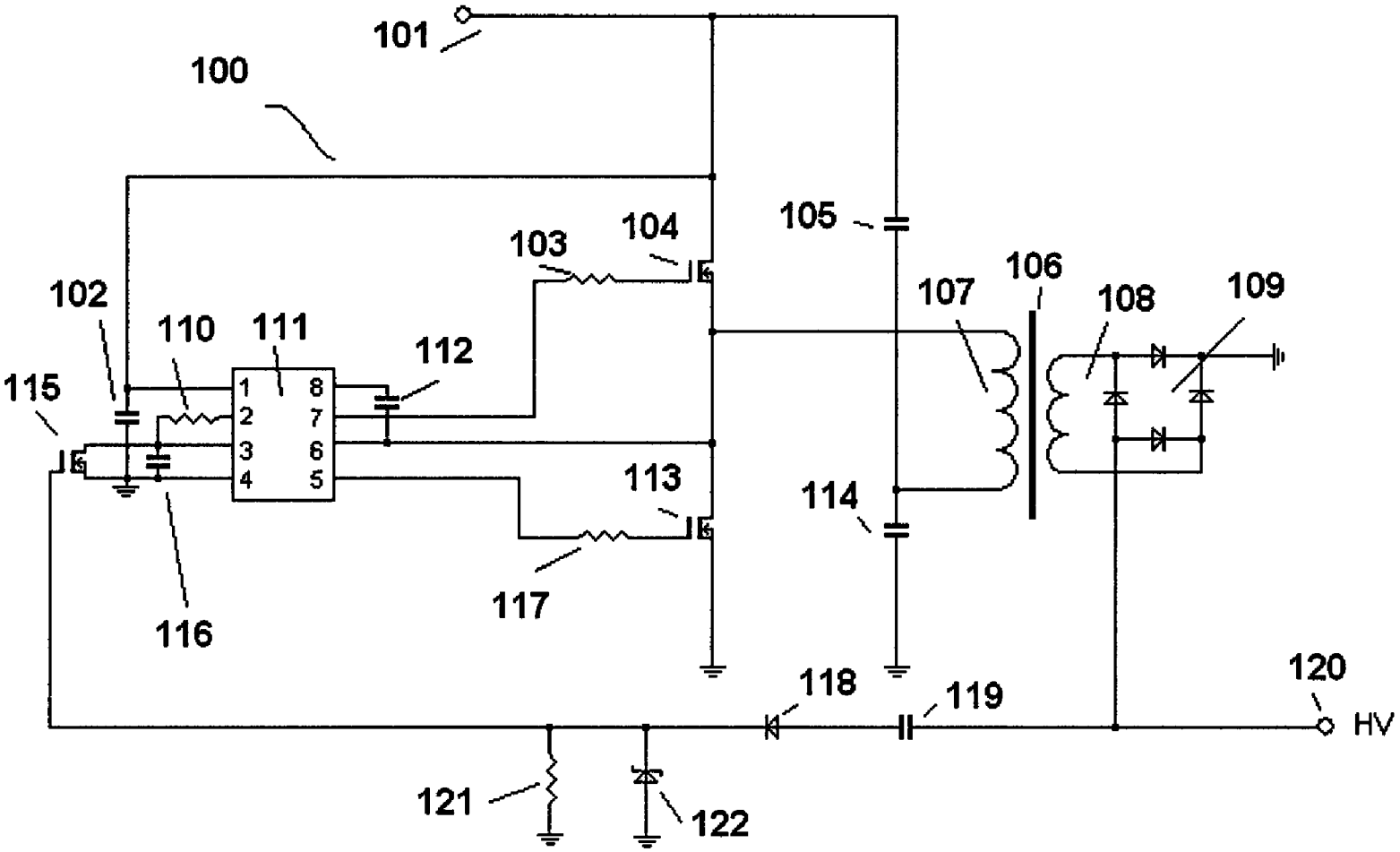
FIG. 1 is a schematic circuit diagram of a high voltage power supply (HVPS) with a low inertia output circuit controllable to rapidly decrease a voltage output level to a level some margin below a dielectric breakdown initiation level.

FIG. 1 is a schematic circuit diagram of high voltage power supply (HVPS) 100 configured to prevent a spark event occurrence in a high voltage device such as electrostatic fluid accelerator. HVPS 100 includes a high voltage set-up transformer 106 with primary winding 107 and the secondary winding 108. Primary winding 107 is connected to an a. c. voltage provided by DC voltage source 101 through half-bridge inverter (power transistors 104, 113 and capacitors 105, 114). Capacitor 102 is connected between power input terminal 1 of gate signal controller 111 and ground. Gate signal controller 111 produces control pulses that are applied through resistors 103 and 117 to the gates of the transistors 104, 113, the frequency of which is determined by the values of resistor 110 and capacitor 116 forming an RC timing circuit. Capacitor 112 is connected from a terminal of gate signal controller 111 to a common connection of the gates of transistors 104 and 113. Secondary winding 108 is connected to voltage rectifier 109 including four high voltage (HV), high frequency diodes configured as a full-wave bridge rectifier circuit. HVPS 100 generates a high voltage between terminal 120 and ground that are connected to a HV device or electrodes (e.g., corona discharge device). An AC component of the voltage applied to the HV device, e.g., across an array of corona discharge electrodes, is sensed by high voltage capacitor 119 through diode 118 and the sensed voltage is limited by zener diode 122. When the output voltage exhibits a characteristic voltage fluctuation preceding a spark, the characteristic AC component of the fluctuation leads to a comparatively large signal level across resistor 121, turning on transistor 115. Transistor 115 grounds pin 3 of the signal controller 111 and interrupts a voltage across the gates of power transistors 104 and 113. With transistors 104 and 113 rendered nonconductive, an almost instant voltage interruption is affected across the primary winding 107 and, therefore, transmitted to the tightly coupled secondary winding 108. Since a similar rapid voltage drop results at the corona discharge device below a spark onset level, any imminent arcing or dielectrical breakdown is avoided.

The spark prevention technique includes two steps or stages. First, energy stored in the stray capacitance of the corona discharge device is discharged through the corona current down to the corona onset voltage. This voltage is always well below spark onset voltage. If this discharge happens in time period that is shorter than about 0.1 msec (i.e., less than 100 mksec), the voltage drop will efficiently prevent a spark event from occurring. It has been experimentally determined that voltage drops from the higher spark onset voltage level to the corona onset level may preferably be accomplished in about 50 mksec.

After the power supply voltage reaches the corona onset level and cessation of the corona current, the discharge process is much slower and voltage drops to zero over a period of several milliseconds. Power supply 100 resumes voltage generation after same predetermined time period defined by resistor 121 and the self-capacitance of the gate-source of transistor 115. The predetermined time, usually on the order of several milliseconds, has been found to be sufficient for the deionization process and normal operation restoration. In response to re-application of primary power to transformer 106, voltage provided to the corona discharge device rises from approximately the corona onset level to the normal operating level in a matter of several microseconds. With such an arrangement no spark events occur even when output voltage exceeds a value that otherwise causes frequent sparking across the same corona discharge arrangement and configuration. Power supply 100 may be built using available electronic components; no special components are required.

Figure 2:
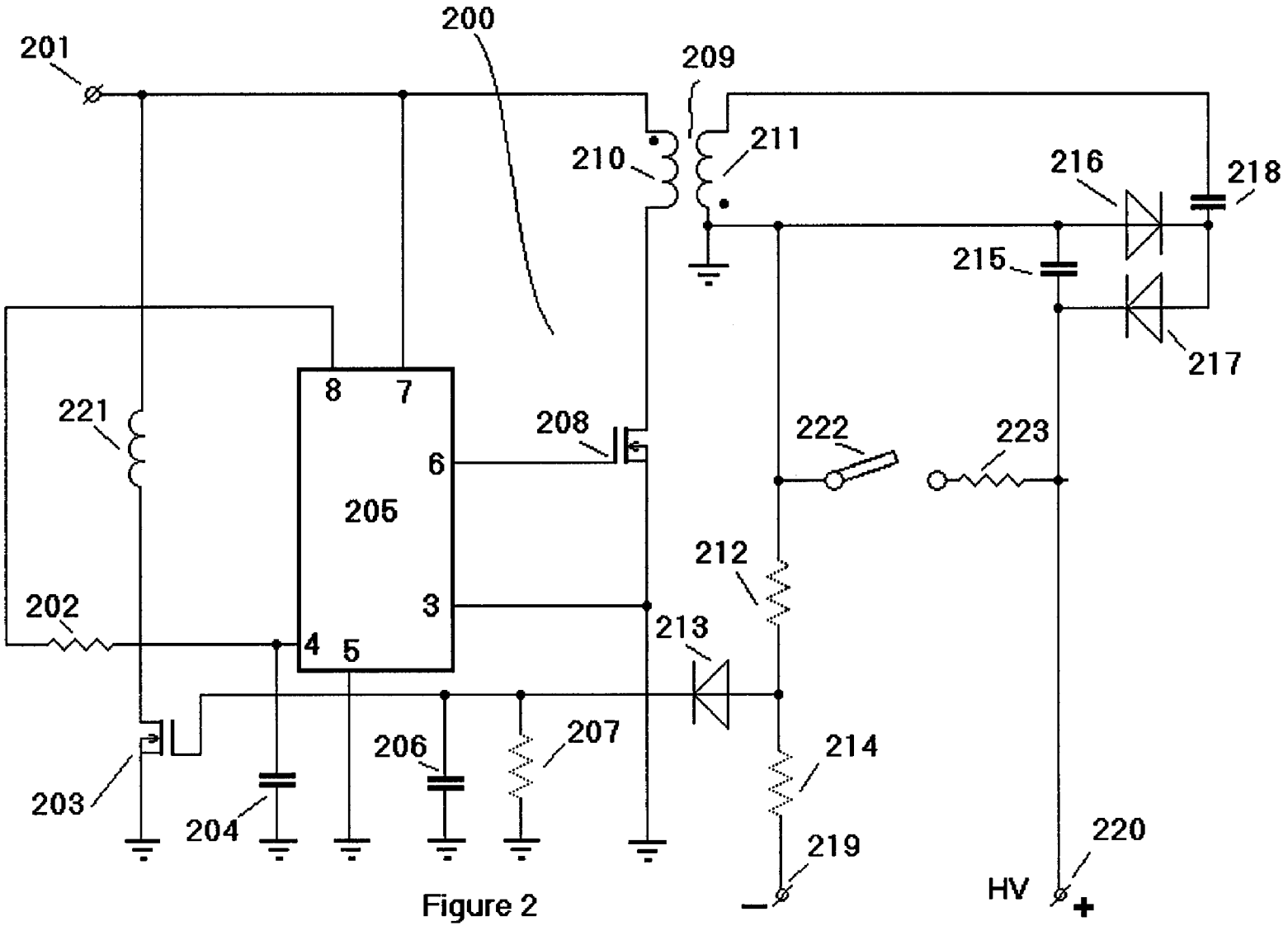
FIG. 2 is a schematic circuit diagram of another high voltage power supply configured to prevent a spark event in high voltage device such as a corona discharge apparatus.

FIG. 2 is a schematic circuit diagram of an alternative power supply 200 with reed contact 222 and an additional load 223. Power supply 200 includes high voltage two winding inductor 209 with primary winding 210 and secondary winding 211. Primary winding 210 is connected to ground through power transistor 208 and to a d.c. power source provided at terminal 201. PWM controller 205 (e.g., a UC 3843 current mode PWM controller) produces control pulses at the gate of the transistor 208, an operating frequency of which is determined by an RC circuit including resistor 202 and capacitor 204. Typical frequencies may be 100 kHz or higher. Secondary winding 211 is connected to a voltage doubler circuit including HV capacitors 215 and 218, and high frequency HV diodes 216 and 217. Power supply 200 generates a HV d.c. power of between 10 and 25 kV and typically 18 kV between output terminals 219 (via resistor 214) and 220 that are connected to a HV device or electrodes (i.e., a load). Control transistor 203 turns ON when current through shunt resistor 212 exceeds a preset level and allows a current to flow through control coil 221 of a reed type relay including reed contacts 222. When current flows through coil 221, the reed contact 222 close, shunting the HV output to HV dumping resistor 223, loading the output and decreasing a level of the output voltage for some time period determined by resistor 207 and capacitor 206. Diode 213 is connected between resistor 207 and the junction of resistors 212 and 214. Using this spark management circuitry in combination with various EFA components and/or device results in a virtual elimination of all sparks during normal operation. Reed relay 203/222 may be a ZP-3 of Ge-Ding Information Inc., Taiwan.

Figure 3:
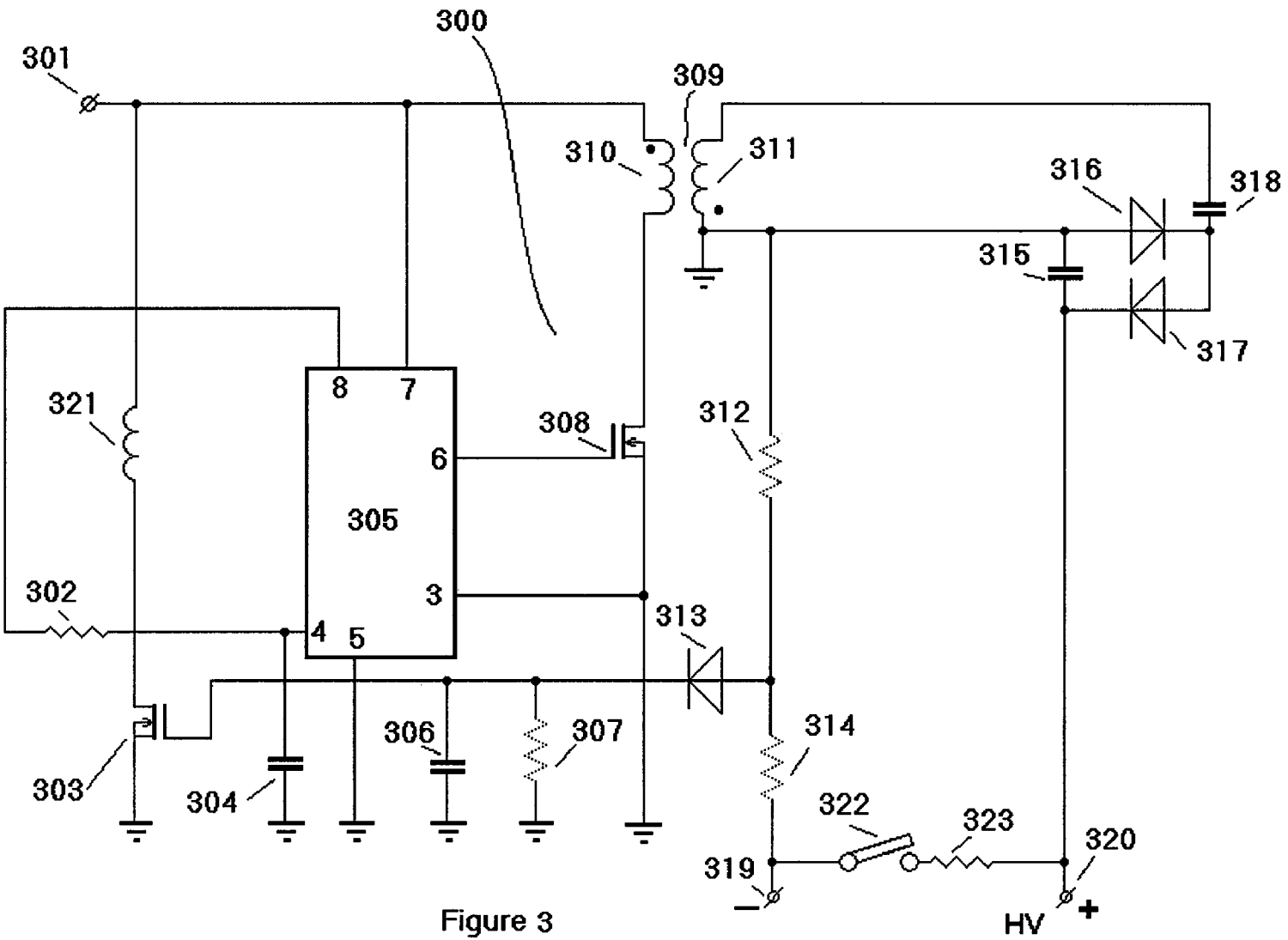
FIG. 3 is a schematic circuit diagram of another high voltage power supply configured to prevent a spark event occurrence in a high voltage device.

FIG. 3 is a schematic circuit diagram of another HVPS arrangement similar to that shown in FIG. 2. However, in this case HVPS 300 includes reed contact 322 and an additional load 323 connected directly to the output terminals of the HVPS. HVPS 300 includes high voltage transformer 309 with primary winding 310 and secondary winding 311. Primary winding 310 is connected to ground through power transistor 308 and to a DC source connected to power input terminal 301. PWM controller 305 (e.g., a UC 3843) produces control pulses at the gate of the transistor 308. An operating frequency of these control pulses is determined by resistor 302 and the capacitor 304. Secondary winding 311 is connected to a voltage doubler circuit that includes HV capacitors 315 and 318 and high frequency HV diodes 316 and 317. HVPS 300 generates a high voltage output of approximately 18 kV at output terminals 319 and 320 that are connected to the HV device or electrodes (the load). Spark control transistor 303 turns ON in response to a voltage level supplied by diode 313 when current through the shunt resistor 312 (and resistor 314 forming a voltage divider circuit with resistor 312 ) exceeds some predetermined preset level and allows current to flow through control coil 321. When current flows through coil 321, reed contact 322 closes to shunt the HV output of the HVPS to HV dumping resistor 323, thereby reducing a level of the output voltage for a time period determined by resistor 307 and capacitor 306. Use of this incipient spark detection and mitigation arrangement results in virtually no spark production for extended periods of operation.

Figure 4:
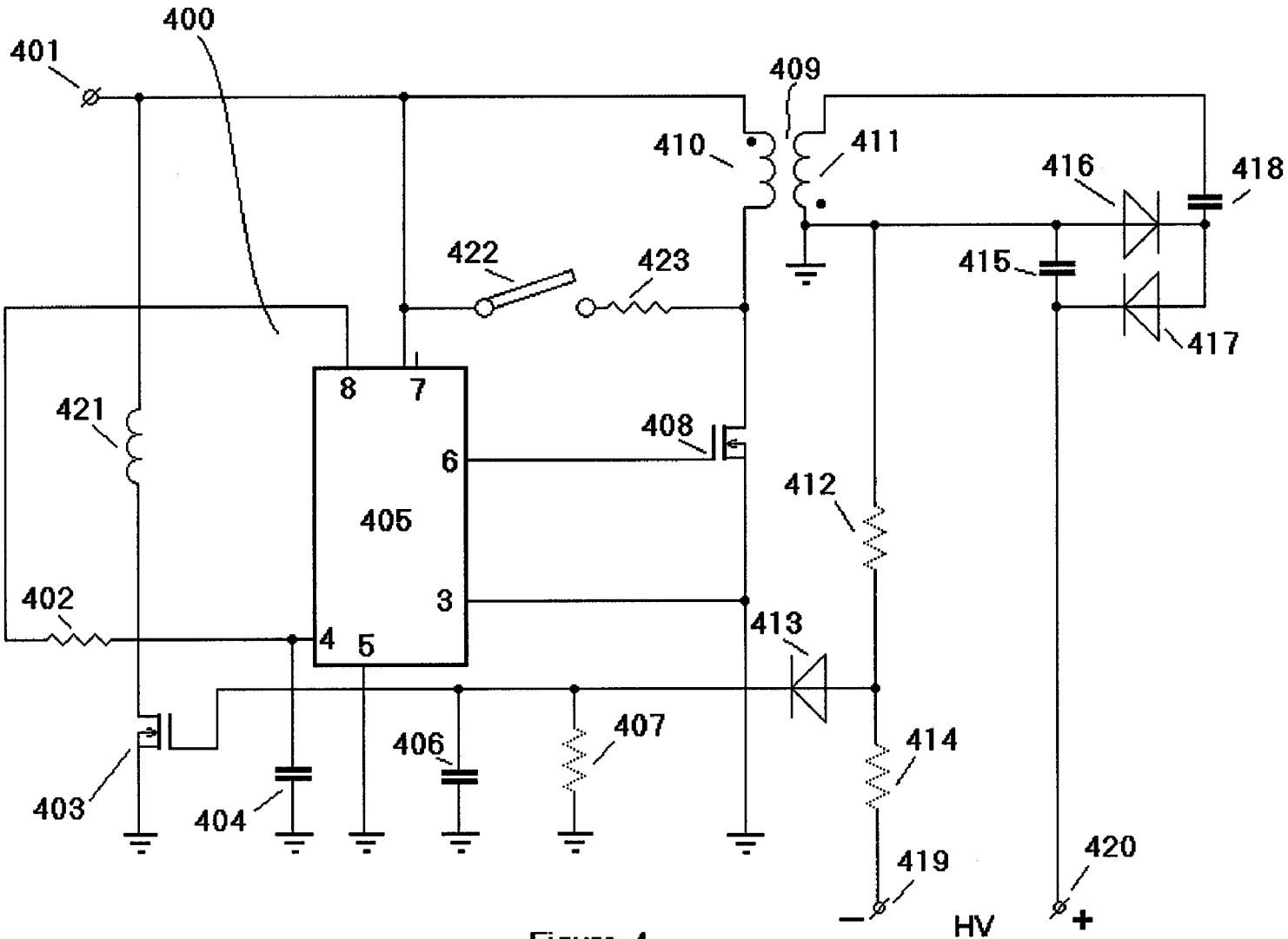
FIG. 4 is a schematic circuit diagram of a high voltage power supply configured to prevent a spark event occurrence in a high voltage device.

FIG. 4 shows a power supply configuration similar to that depicted in FIG. 2, HVPS 400 further including relay including normally open contacts 422 and coil 421, and power dumping load 423. HVPS 400 includes power transformer 409 with primary winding 410 and the secondary winding 411. Primary winding 410 is connected to ground through power transistor 408 and to a d.c. power source at terminal 401. PWM controller 405 (e.g., a UC 3843) produces a train of control pulses at the gate of the transistor 408. An operating frequency of these pulses is set by the resistor 402 and capacitor 404. Secondary winding 411 is connected to supply a high voltage (e.g., 9 kV) to a voltage doubler circuit that includes HV capacitors 415 and 418, and high frequency HV diodes 416 and 417. Power supply 400 generates a high voltage output at terminals 419 and 420 that are connected to the HV device or corona electrodes (load). Control transistor 403 turns ON in response to a voltage level supplied by diode 413 when current through shunt resistor 412 (and series resistor 414 forming a voltage divider with resistor 412) exceeds some preset level predetermined to be characteristic of an incipient spark event, allowing current to flow through coil 421. When current flows through the coil 421, relay contact 422 closes, shortening primary winding 410 through dumping resistor 423. The additional load provided by dumping resistor 423 rapidly decreases the output voltage level over some period of time determined by resistor 407 and capacitor 406.

Figure 5:
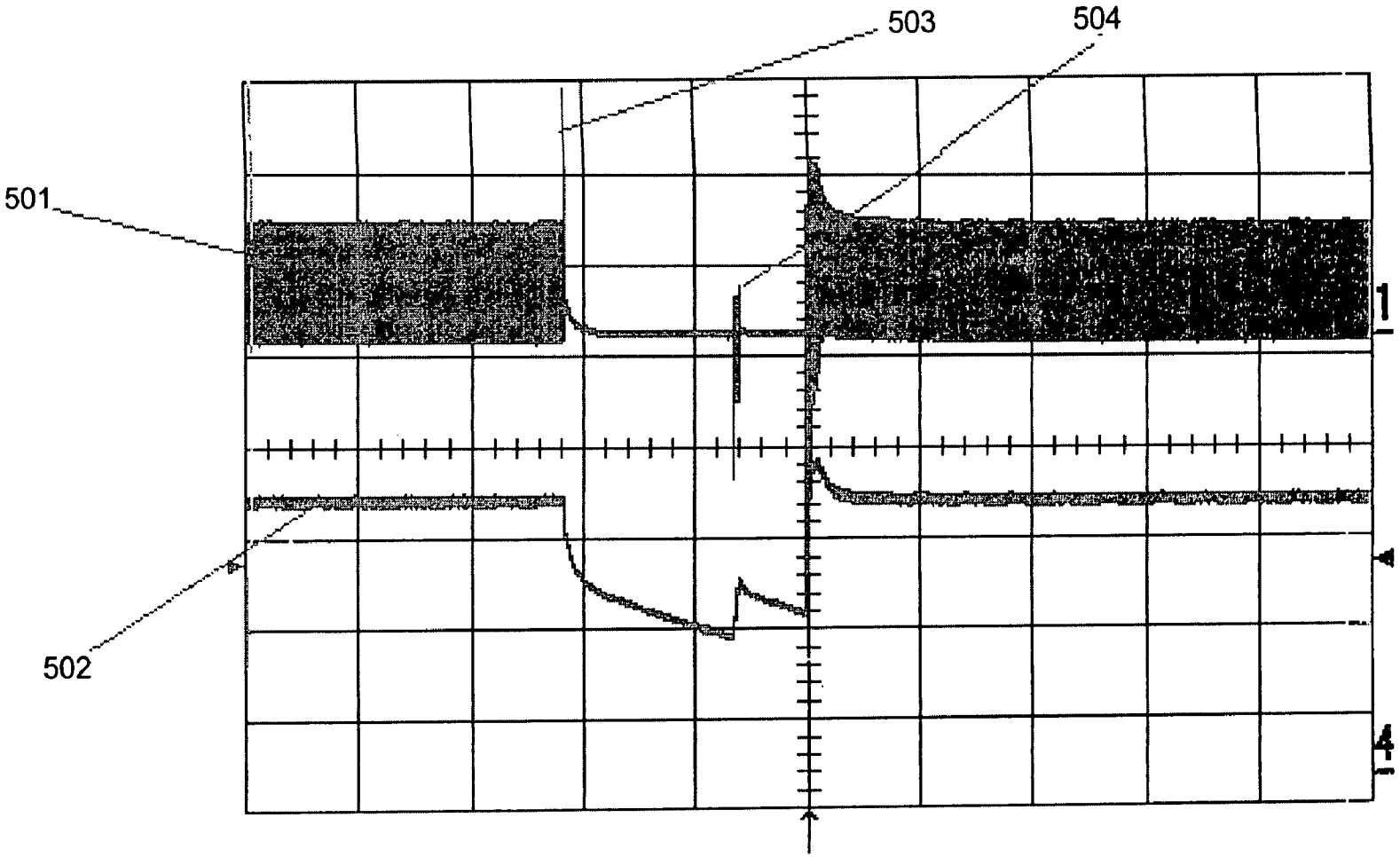
FIG. 5 is an oscilloscope trace of an output corona current and output voltage at a corona discharge electrode of an electrostatic fluid accelerator receiving power from a HVPS configured to anticipate and avoid spark events.

FIG. 5 is an oscilloscope display including two traces of a power supply output in terms of a corona current 501 and output voltage 502. As it can be seen corona current has a characteristic narrow spike 503 indicative of an incipient spark event within a time period of about 0.1 to 1.0 msec, herein shown at about 2.2 msec after the current spike. Detection of current spike 503 in corona discharge or similar HV apparatus triggers a control circuit, turns the HVPS OFF and preferably dumps any stored energy necessary to lower an electrode potential to or below a dielectric breakdown safety level. Thus, in addition to interrupting primary power to the HVPS by, for example, inhibiting an operation of a high frequency pulse generator (e.g., PWM controller 205), other steps may be taken to rapidly lower voltage applied to the HV apparatus to a level below a spark initiation or dielectric breakdown potential. These steps and supportive circuitry may include "dumping" any stored charge into an appropriate "sink", such as a resistor, capacitor, inductor, or some combination thereof. The sink may be located within the physical confines of the HVPS and/or at the device being powered, i.e., the HV apparatus or load. If located at the load, the sink may be able to more quickly receive a charge stored within the load, while a sink located at the HVPS may be directed to lower a voltage level of the HVPS output. Note that the sink may dissipate power to lower the voltage level supplied to or at the load using, for example, a HV resistor. Alternatively, the energy may be stored and reapplied after the spark event has been addressed to rapidly bring the apparatus back up to an optimal operating. Further, it is not necessary to lower the voltage to a zero potential level in all cases, but it may be satisfactory to reduce the voltage level to some value known or predicted to avoid a spark event. According to one embodiment, the HVPS includes processing and memory capabilities to associate characteristics of particular pre-spark indicators (e.g., current spike intensity, waveform, duration, etc.) with appropriate responses to avoid or minimize, to some preset level, the chance of a spark event. For example, the HVPS may be responsive to an absolute amplitude or an area under a current spike $$\left(\text{i.e., } \int_{t1}^{t2} (i_t - i_{average})dt\right)$$

for selectively inserting a number of loads previously determined to provide a desired amount of spark event control, e.g., avoid a spark event, delay or reduce an intensity of a spark event, provide a desired number or rate of spark events, etc.

Referring again to FIG. 5, if an output of the HVPS is totally interrupted, with no current flowing to the corona discharge apparatus, the voltage across the corona discharge device rapidly drops as shown in the FIG. 5 and described above. After some short period, a current spike 504 may be observed that indicates the moment when actual spark event would have occurred had no action been taken to reduce the voltage level applied to the HV device. Fortunately, since the output voltage is well below the spark level, no spark or arc is produced. Instead, only a moderate current spike is seen which is sufficiently small as to not cause any disturbances or undesirable electrical arcing sound. After a certain period on the order of 2-10 msec after detection of current spike 504 or 1-9 msec after current spike 503, the HVPS turns ON and resumes normal operation.

Figure 6:
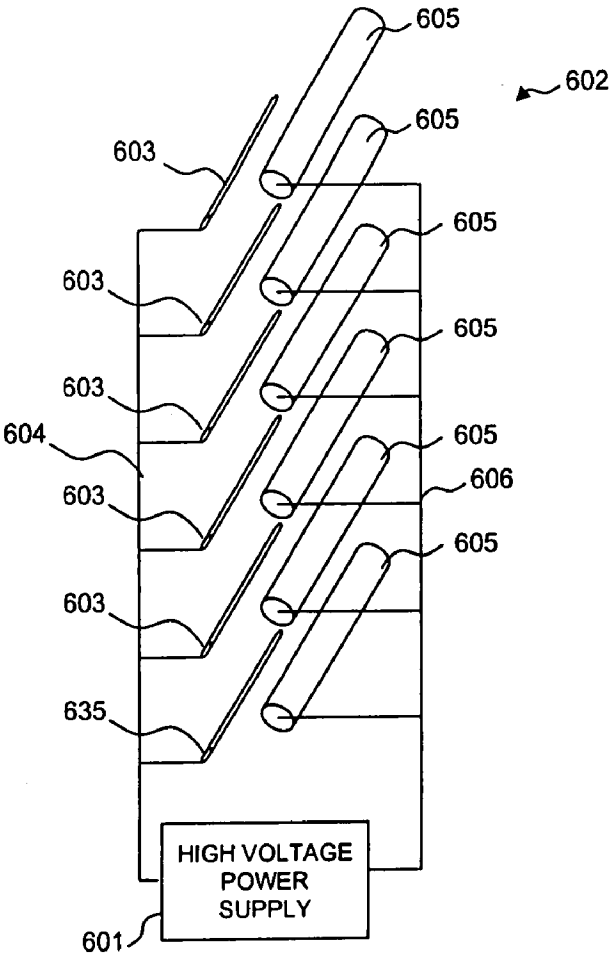
FIG. 6 is a diagram of a HVPS connected to supply HV power to an electrostatic device.

FIG. 6 is a diagram of HVPS 601 according to an embodiment of the invention connected to supply HV power to an electrostatic device 602, e.g., a corona discharge fluid accelerator. Electrostatic device 602 may include a plurality of corona discharge electrodes 603 connected to HVPS 601 by common connection 604. Attractor or collector electrodes 605 are connected to the complementary HV output of HVPS 601 by connection 606. Upon application of a HV potential to corona discharge electrodes 603, respective corona discharge electron clouds are formed in the vicinity of the electrodes, charging the intervening fluid (e.g., air) molecules acting as a dielectric between corona discharge electrodes 603 and the oppositely charged attractor or collector electrodes 605. The ionized fluid molecules are accelerated toward the opposite charge of collector/attractor electrodes 605, resulting in a desired fluid movement. However, due to various environmental and other disturbances, the dielectric properties of the fluid may vary. This variation may be sufficient such that the dielectric breakdown voltage may be lowered to a point where electrical arcing may occur between sets of corona discharge and attractor electrodes 603, 605. For example, dust, moisture, and/or fluid density changes may lower the dielectric breakdown level to a point below the operating voltage being applied to the device. By monitoring the electrical characteristics of the power signal for a pre-spark signature event (e.g., a current spike or pulse, etc.), appropriate steps are implemented to manage the event, such as lowering the operating voltage in those situations wherein it is desirable to avoid a spark.

While the embodiment described above is directed to eliminating or reducing a number and/or intensity of spark events, other embodiments may provide other spark management facilities capabilities and functionalities. For example, a method according to an embodiment of the invention may manage spark events by rapidly changing voltage levels (for example, by changing duty cycle of PWM controller) to make spark discharge more uniform, provide a desired spark intensity and/or rate, or for any other purpose. Thus, additional applications and implementations of embodiments of the current invention include pre-park detection and rapid voltage change to a particular level so as to achieve a desired result.

According to embodiments of the invention, three features provide for the efficient management of spark events. First, the power supply should be inertialess. That means that the power supply should be capable of rapidly varying an output voltage in less time than a time period between a pre-spark indicator and occurrence of a spark event. That time is usually in a matter of one millisecond or less. Secondly, an efficient and rapid method of pre-spark detection should be incorporated into power supply shut-down circuitry. Third, the load device, e.g., corona discharge device, should have low self-capacitance capable of being discharged in a time period that is shorter than time period between a pre-spark signature and actual spark events.

It should be noted and understood that all publications, patents and patent applications mentioned in this specification are indicative of the level of skill in the art to which the invention pertains. All publications, patents and patent applications are herein incorporated by reference to the same extent as if each individual publication, patent or patent application was specifically and individually indicated to be incorporated by reference in its entirety.

We claim:

1. A method of spark management comprising the steps of:
supplying a high voltage power to a device;
detecting an imminent pre-spark condition of said device; and
adjusting a voltage level of said high voltage power to a level inhibiting a spark event associated with said imminent pre-spark condition in response to detecting said imminent pre-spark condition, said level achieved within 1 millisecond of detecting said imminent pre-spark condition.

2. The method according to claim 1 wherein said step of supplying a high voltage power includes the steps of:
transforming a source of electrical power from a primary voltage level to a secondary voltage level higher than said primary voltage level; and
rectifying said electrical power at said secondary voltage level to supply said high voltage power to said device.

3. The method according to claim 1 wherein said step of detecting includes a step of sensing a current spike in said high voltage power.

4. The method according to claim 1 wherein said step of detecting includes a step of sensing output voltage parameters of said high voltage power.

5. The method according to claim 1 further comprising the steps of:
introducing a fluid to a corona discharge electrode;
electrifying said corona discharge electrode with said high voltage power; generating a corona discharge into said fluid; and
accelerating said fluid under influence of said corona discharge.

6. The method according to claim 1 wherein said level inhibiting said spark event is achieved in less than 0.1 millisecond of detection of said imminent pre-spark condition.

7. The method according to claim 1 further comprising, subsequent to adjusting said voltage level of said high voltage power to said level inhibiting a spark event, and within a time period of from 2 to 10 milliseconds after detecting an imminent pre-spark condition, increasing said voltage level of said high voltage to a normal operating level.

8. The method according to claim 1 wherein said step of adjusting further comprises a step of reducing a voltage level of said high voltage power to a level inconducive to spark generation.

9. The method according to claim 8 wherein said step of adjusting includes a step of routing at least a portion of said high voltage power to an auxiliary loading device.

10. The method according to claim 9 wherein said step of routing at least a portion of said high voltage power to said auxiliary loading device includes connecting an additional load to an output circuit of a high voltage power supply supplying said high voltage power.

11. A method of spark management comprising the steps of:
supplying an electric power to an electrical device;
monitoring one or more electromagnetic parameters in said electrical device;
identifying an imminent pre-spark condition in said electrical device in response to said step of monitoring; and
changing a magnitude of said electric power to a desirable level in response to and within a time period of not greater than 1 millisecond of identifying said imminent pre-spark condition.

12. The method according to claim 11 wherein said step of monitoring includes measuring a current level of said electric power.

13. The method according to claim 11 wherein said step of changing a magnitude of said electric power includes decreasing a voltage of said electric power to a level inhibiting spark generation.

14. The method according to claim 11 wherein said step of changing a magnitude of said electric power includes diverting a portion of said electric power from said electrical device to a load circuit.

15. The method according to claim 11 further comprising the step of accelerating a fluid under influence of an electrostatic three created by operation of a corona discharge powered by said electric power.

16. The method according to claim 11 wherein said time period is not greater than 0.1 millisecond.

17. The method according to claim 11 further comprising, subsequent to changing a magnitude of said electric power to a desirable level, and within a time period of from 2 to 10 milliseconds after identifying an imminent pre-spark condition, increasing said magnitude of said electric power back to a normal operating level.

18. A method of operating a corona discharge device comprising the steps of:

supplying a high voltage power to an electrostatic device;

monitoring an electromagnetic parameter of said high voltage power to detect an imminent pre-spark condition present in said electrostatic device; and adjusting a voltage level of said high voltage power in response to and within a time period of not greater than 1 millisecond of detecting said imminent pre-spark condition.

19. The method according to claim 18 wherein said step of monitoring includes measuring a current level of said electric power.

20. The method according to claim 18 wherein said step of adjusting a magnitude of said electric power includes decreasing a voltage of said electric power to a level inhibiting spark generation.

21. The method according to claim 18 wherein said step of adjusting a magnitude of said electric power includes diverting a portion of said electric power from said corona discharge device to a load circuit.

22. The method according to claim 18 further comprising the step of accelerating a fluid under influence of an electrostatic force created by said corona discharge device powered by said electric power.

23. The method according to claim 18 wherein said time period is not greater than 0.1 millisecond.

24. The method according to claim 18 further comprising, subsequent to adjusting a voltage level of said high voltage power, and within a time period of from 2 to 10 milliseconds after detecting an imminent pre-spark condition, increasing said voltage level of said high voltage power back to a normal operating level existing prior to said adjusting step.

25. A method of spark management comprising the steps of:

supplying a high voltage to a load device using a low inertia high voltage power supply;

monitoring electromagnetic parameters associated with the load device, the electromagnetic parameters providing indicia associated with and preceding occurrence of a spark event; and in response to said indicia, rapidly and within a time period of no greater than 1 millisecond decreasing said high voltage to a level not supporting spark generation.

26. The method according to claim 25 wherein said step of supplying a high voltage includes the steps of:

converting a source of electrical power from a primary DC voltage to an AC voltage having a frequency of at least 20 kHz;

transforming said AC voltage from a primary AC voltage level to a secondary AC voltage level higher than said primary AC voltage level; and rectifying said AC voltage at said secondary voltage level to supply said high voltage power to said load device.

27. The method according to claim 25 wherein said time period is not greater than 0.1 millisecond.

28. The method according to claim 25 further comprising, subsequent to rapidly decreasing said high voltage to a level not supporting spark generation, and within a time period of from 2 to 10 milliseconds after said indicia associated with and preceding occurrence of said spark event, increasing said high voltage back to a normal operating level.

29. The method according to claim 25 wherein said step of monitoring includes a step of sensing an output voltage parameter of said high voltage power.

30. The method according to claim 29 wherein said output voltage parameter is selected from the set comprising an a.c. component of said high voltage and a time rate of change (dV/dt) of said high voltage.

31. A method of operating a corona discharge device comprising the steps of:

supplying a high voltage to the electrostatic device using a low inertia high voltage power supply;

monitoring electromagnetic parameters that precede a spark event to identify an imminent spark condition in said electrostatic device; and decreasing said high voltage to a level not supporting spark generation within 1 millisecond of identification of said imminent spark condition.

32. The method according to claim 31 wherein said time period is not greater than 0.1 millisecond.

33. The method according to claim 31 further comprising, subsequent to decreasing said high voltage, and within a time period of from 2 to 10 milliseconds after identification of said imminent spark condition, increasing said high voltage to a normal operating level.

* * * * *